US006315160B1

(12) United States Patent
Gaiser et al.

(10) Patent No.: US 6,315,160 B1
(45) Date of Patent: Nov. 13, 2001

(54) SYSTEM AND METHOD FOR DISPENSING VISCUOUS MATERIAL

(75) Inventors: Rick Gaiser, Spring Grove; Val Hierzer, Arlington Heights; Bob Simpson, Grayslake, all of IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/484,074

(22) Filed: Jan. 18, 2000

(51) Int. Cl.[7] ..... G01F 11/00

(52) U.S. Cl. ..... 222/1; 222/145.5; 222/424; 222/546

(58) Field of Search ..... 222/1, 145.5, 145.6, 222/424, 546, 564

(56) References Cited

U.S. PATENT DOCUMENTS 4,146,157 * 3/1979 Dixon, Sr. et al. ..... 222/424
5,152,432 * 10/1992 De Laforcade ..... 222/145.5
5,310,091 * 5/1994 Dunning et al. ..... 222/145.5
5,509,579 * 4/1996 Robbins, III ..... 222/424

* cited by examiner

*Primary Examiner*—Joseph A. Kaufman
(74) *Attorney, Agent, or Firm*—Knoble & Yoshida, LLC

(57) ABSTRACT

A closure for dispensing a viscous material such as mustard or ketchup from a container includes a threaded closure body having a dispensing orifice through which viscous material may flow during dispensing, and a collection space for collecting a volume of thin liquid that may form on top of the viscous material during storage. The collection space acts to intercept the thin liquid as the container is inverted to dispense the viscous material. As the material continues to be dispensed, the thin liquid is re-mixed into the material, thereby keeping the solid to liquid ratio of the material in the container relatively constant. A method of dispensing viscous material such as ketchup or mustard is also disclosed.

15 Claims, 3 Drawing Sheets

SYSTEM AND METHOD FOR DISPENSING VISCUOUS MATERIAL

BACKGROUND OF THE INVENTION

1. Field of the Invention

The invention relates generally to dispensing closures for dispensing containers of the type that are used to store and dispense viscous materials such as mustard and ketchup.

2. Description of the Related Technology

Containers that are used to store and dispense viscous foodstuffs and condiments such as ketchup and mustard employ a wide variety of closures in the United States and throughout the world. One commercially popular closure is shaped as a conical spout, and utilizes a twist-valve to open and close the dispensing passage. A second popular closure has a pivotally mounted snap-lid capable of being moved between a closed and an open dispensing position. In the closed position, the lid covers the dispensing opening and in the open position, the lid is moved away from the opening to allow the product in the container to be dispensed.

One problem that besets viscous foodstuffs such as ketchup and mustard is that thin liquid, e.g. the vinegar and aqueous base of the mixture, tends during periods of nonuse to form at the top of the container as suspended solids settle towards the bottom. When the container is inverted by a user to dispense the material, the thin liquid because of its initial position within the container and its lower viscosity will reach and be expelled from the closure opening before the more viscous material. Many consumers find this discharge of thin liquid to be unpleasant, and would rather not have it on their food. The thin liquid can also aerosolize as it is expelled from the closure and thus spray about in an uncontrolled manner that can make an unpleasant mess.

Consumers are advised to shake the container to mix the viscous material inside before dispensing, but this is often forgotten or avoided. Besides the unpleasant aspects of unmixed dispensing that are described above, premature depletion of the liquids from the suspension of the viscous material can lead to dehydration and thickening of the material.

A need exists for an improved system and method of dispensing viscous materials such as ketchup and mustard that reduces the potential for dribbling, spraying, mess-making and dehydration of the material as a result of early expulsion of the thin liquid component of the material during dispensing.

SUMMARY OF THE INVENTION

Accordingly, it is an object of this invention to provide an improved system and method of dispensing viscous materials such as ketchup and mustard that reduces the potential for dribbling, spraying, mess-making and dehydration of the material as a result of early expulsion of the thin liquid component of the material during dispensing.

In order to achieve the above and other objects of the invention, a closure for dispensing a viscous material from a container includes, according to a first aspect of the invention, securing structure for securing the closure to a container; orifice defining structure for defining an orifice through which a viscous material may flow during dispensing of the viscous material from the container; and thin liquid collecting structure for collecting a volume of thin liquid that may form on top of the viscous material during storage, whereby the amount of thin liquid that will be initially dispensed from the closure will be reduced.

A closure for dispensing a viscous material from a container according to a second aspect of the invention includes a closure body having at least one thread defined on an inner surface thereof for engaging an external thread on a container, and a dispensing orifice through which viscous material may flow during dispensing; and a collection space for collecting a volume of thin liquid that may form on top of the viscous material during storage, whereby the amount of thin liquid that will be initially dispensed from the closure will be reduced.

A method of dispensing a viscous material according to a third aspect of the invention includes steps of opening a container of viscous material by opening a closure that is secured to the container; inverting the container to induce the viscous material to flow out of the container through the closure; and intercepting a volume of thin liquid that may have formed on top of the viscous material during storage before the volume of thin liquid passes out of the closure, thereby ensuring that the material first dispensed from the container will be more representative of the viscous material than the thin liquid.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
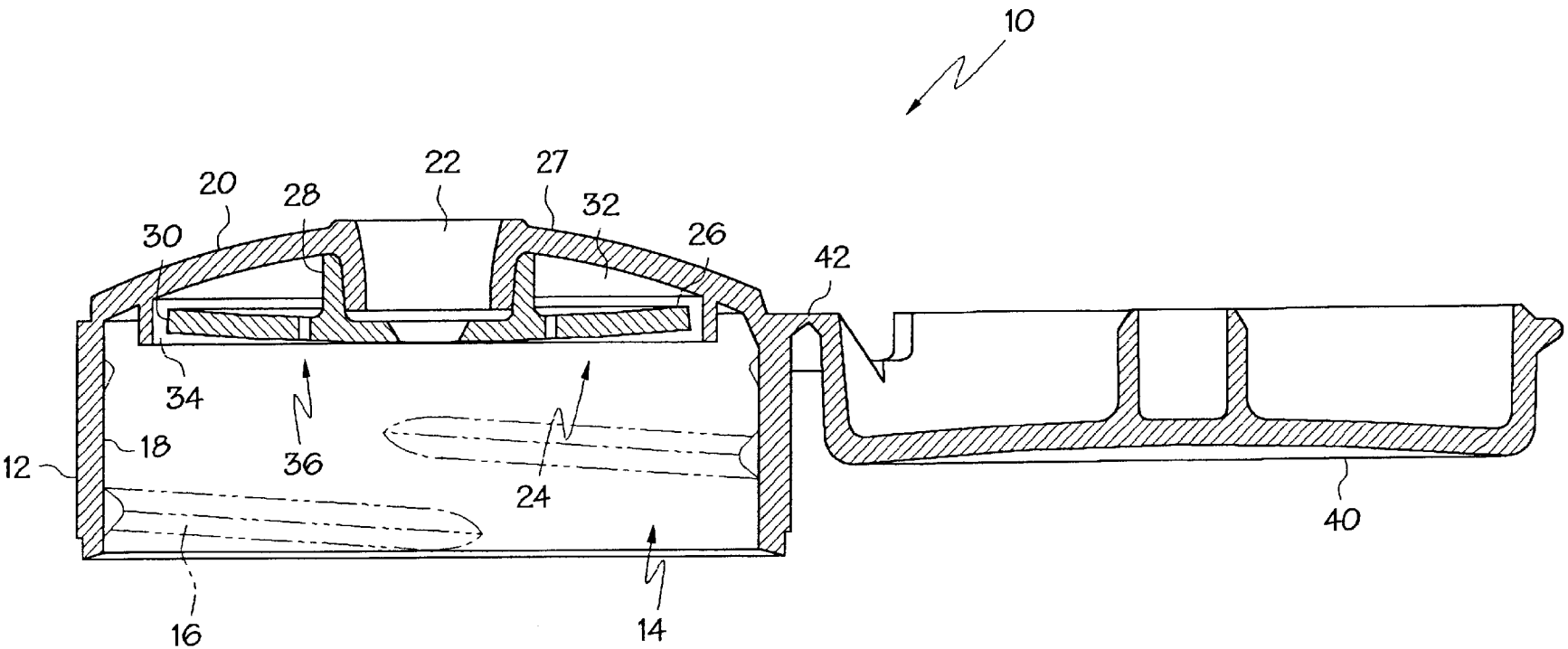
FIG. 1 is a cross-sectional view of a closure that is constructed according to a preferred embodiment of the invention, shown in a first operative position.
Figure 2:
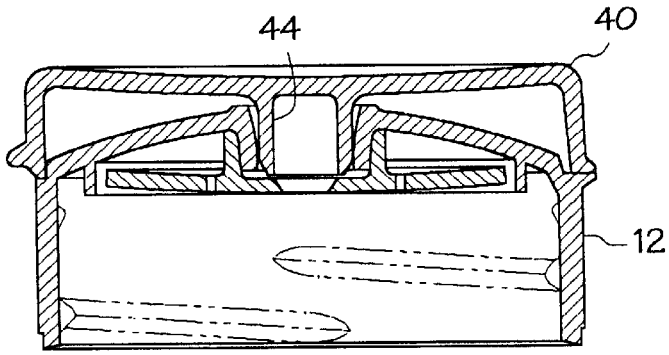
FIG. 2 is a cross-sectional view of the closure shown in FIG. 1, shown in a second operative position.

Referring now to the drawings, wherein like reference numerals designate corresponding structure throughout the views, and referring in particular to FIG. 1, a closure 10 for dispensing a viscous material from a container that is constructed according to the preferred embodiment of the invention includes a closure body 12 having securing structure 14 for securing the closure 10 to a container, which in the preferred embodiment is constructed as at least one helical thread 16 that is defined on the inner surface 18 of the closure body 12. Alternatively, the securing structure 14 could be embodied as an interference fit, a bayonet or snap connection, or one of many other mechanically equivalent techniques that are well known to those of ordinary skill in this area of technology.

As may further be seen in FIG. 1, closure body 12 includes a top portion 20 that is shaped so as to define an orifice 22, which is preferably, although not necessarily, centered with respect to the top portion 20. According to one important aspect of the invention, structure 24 is provided for collecting a thin liquid that may form on top of the viscous material during storage, so that the amount of thin liquid that will be initially dispensed from the closure 10 will be reduced. In the illustrated embodiment, the thin liquid collecting structure 24 includes a disk-like member 26 that is secured to the interior of the closure body 12 by means of a flange 28 that is pressure-fitted into the structure on the top portion 22 of the closure body 12 that defines the orifice 22. Disk-like member 26, together with the dome 27 that forms the top portion 20 of closure body 12 defines a collection space 32 that may best be seen in FIG. 1.

Figure 4A:
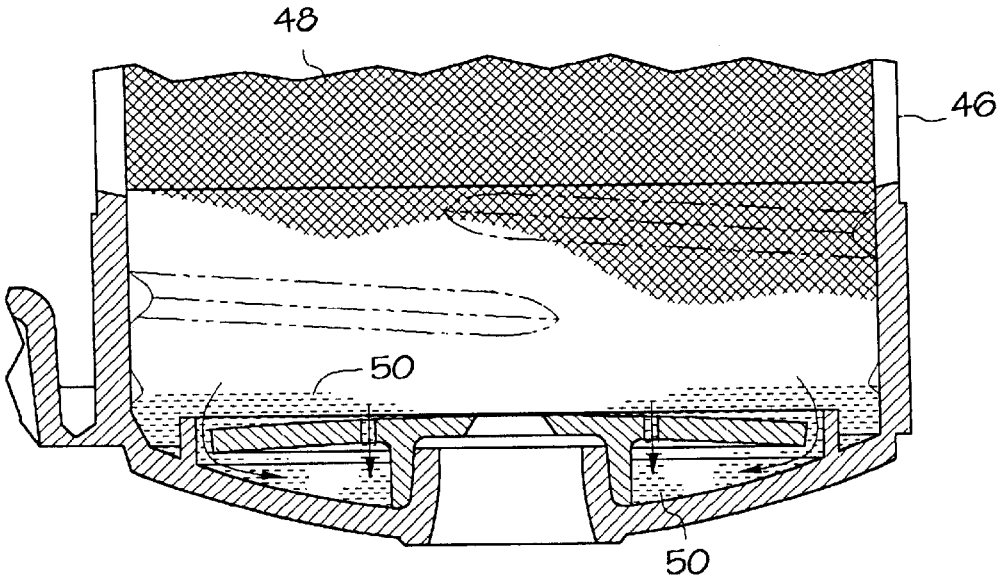
FIGS. 4(*a*) and 4(*b*) depict a method of dispensing that is performed according to a preferred embodiment of the invention.
Figure 4B:
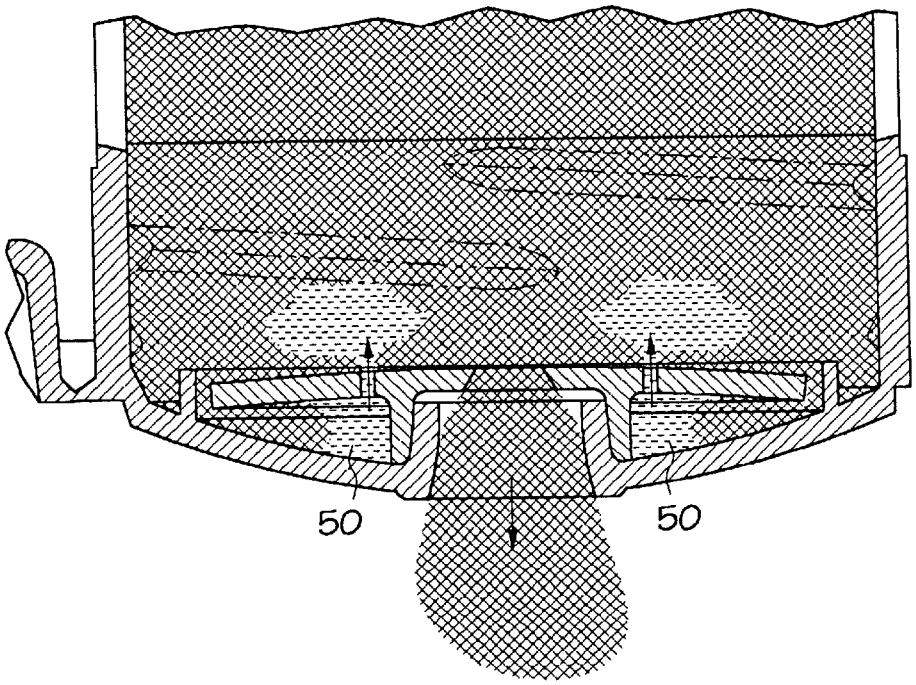

As may further be seen in FIG. 1, the disk-like member 26 has an outer edge 30 that together with the interior of closure body 12 defines a first passageway 34 between the collection space 32 and a space that is in communication with a container during dispensing, as is shown in FIGS. 4(*a*) and 4(*b*). A second passageway 36 is also defined between the collection space 32 and the space that is in communication with the container during dispensing. In the preferred embodiment, the first passageway 34 presents less resistance to flow of the viscous material therethrough than does the second passageway 36, so that the viscous material will enter the collections space through the first passageway as dispensing progresses, thereby displacing thin liquid from the collection space 32 through the second passageway 36. As a result, the thin liquid is re-mixed into the the material as it continues to be dispensed. In the preferred embodiment, the second passageway 36 is also closer to the orifice 22 then is the first passageway 34.

Figure 3:
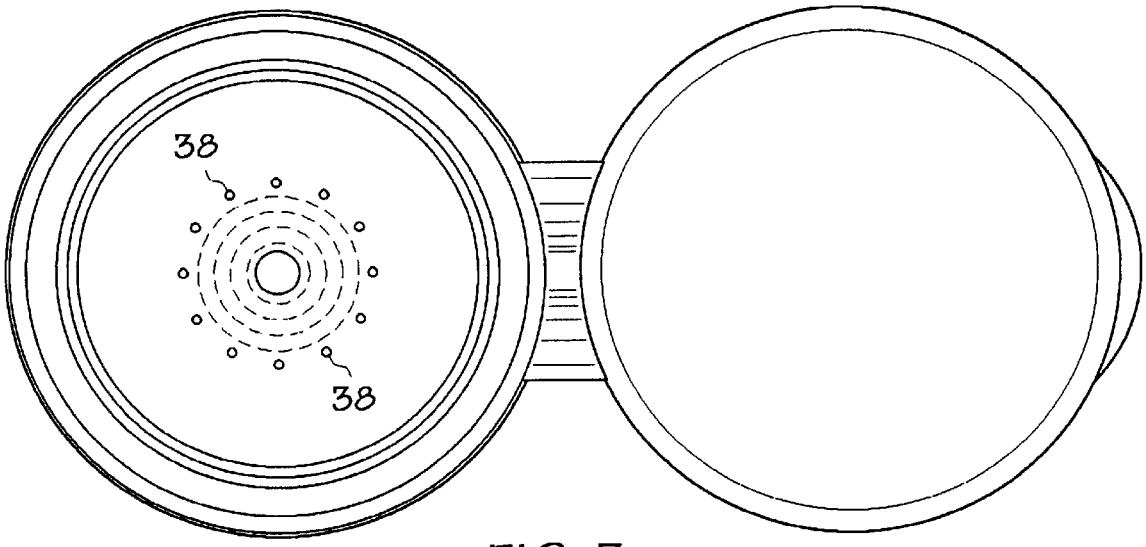
FIG. 3 is a bottom plan view of the closure shown in FIGS. 1 and 2.

As may be seen in FIG. 3, the second passageway is preferably embodied as a plurality of through holes 38 in the disk-like member 26 that are arranged in a circular pattern.

Referring now to FIGS. 4(*a*) and 4(*b*), the operation of closure 10 will be described. Container 46 is first filled with a viscous material 48, such as ketchup or mustard, and the closure 10 is secured to the container 46. The container 46 will then be provided to the consumer in the ordinary course of commerce, and when a consumer desires to dispense viscous material 48 from the container 46, he or she will open the closure 10 and invert the container 46 to the position that is shown in FIG. 4(*a*). The thin liquid 50 that will have collected on top of the the viscous material while it has been stored will tend to run down the inside of the container 46 into the closure 10, and a volume of this thin liquid will be intercepted by the liquid collecting structure 24. More specifically, the thin liquid 50 will be admitted into collection space 32 through the first and second passageways 34, 36. As the consumer continues to invert and squeeze the container 46, the viscous material 48 will make its way into the closure and against the dislike member 26, and as the consumer continues to dispense from the container 46 the viscous material 48 will begin to enter the collection space 32 through the first passageway 34, as shown in FIG. 4(*b*). As this occurs, the volume of thin liquid 50 that has collected in collection space 32 will be displaced from the collection space 32 through the holes 38 in the disk-like member 26 and will be re-mixed into the viscous material 48 before it is expelled from the orifice 22. Accordingly, the thin liquid 50 will be dispensed along with the rest of the viscous material 48, rather than prematurely.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A closure for dispensing a viscous material from a container, comprising:

securing means for securing the closure to a container;

orifice defining means for defining an orifice through which a viscous material will flow during dispensing of the viscous material from the container; and thin liquid collecting means for collecting thin liquid that has formed on top of the viscous material during storage, said thin liquid collecting means comprising a collection space, a first passageway defined between the collection space and a space that is in communication with the container during dispensing, and a second passageway defined between the collection space and a space that is in communication with the container during dispensing, and wherein said first passageway presents less resistance to flow of the viscous material therethrough than does the second passageway, whereby the viscous material will enter the collection space through the first passageway as dispensing progresses, thereby displacing thin liquid from the collection space through the second passageway to re-mix into the viscous material as it continues to be dispensed.

2. A closure according to claim 1, wherein said securing means comprises at least one thread defined on an inner surface of the closure.

3. A closure according to claim 1, wherein the second passageway is closer to the orifice than the first passageway.

4. A closure according to claim 1, wherein said thin liquid collecting means comprises a disk member that is affixed to an inner portion of said closure, said disk member defining in part said collection space, and said first passageway comprises an annular passage defined between an outer edge of said disk member and an inner surface of the closure.

5. A closure according to claim 4, wherein said second passageway comprises a plurality of holes defined in said disk member.

6. A closure according to claim 1, further comprising closing means for closing the orifice when the container is not in use.

7. A closure according to claim 6, wherein said closing means comprises a closure cap.

8. A closure for dispensing a viscous material from a container, comprising:

a closure body having at least one thread defined on an inner surface thereof for engaging an external thread on a container, and a dispensing orifice through which viscous material flows during dispensing; and a collection space for collecting a volume of thin liquid that forms on top of the viscous material during storage;

a first passageway defined between the collection space and a space that is in communication with the container during dispensing; and a second passageway defined between the collection space and a space that is in communication with the container during dispensing, and wherein said first passageway presents less resistance to flow of the viscous material therethrough than does the second passageway, whereby the viscous material will enter the collection space through the first passageway as dispensing progresses, thereby displacing thin liquid from the collection space through the second passageway to re-mix into the viscous material as it continues to be dispensed.

9. A closure according to claim 8, wherein the second passageway is closer to the orifice than the first passageway.

10. A closure according to claim 9, wherein the collection space is defined in part by a disk member that is affixed to an inner portion of said closure, and said first passageway comprises an annular passage defined between an outer edge of said disk member and an inner surface of the closure.

11. A closure according to claim 10, wherein said second passageway comprises a plurality of holes defined in said disk member.

12. A closure according to claim 8, further comprising closing means for closing the orifice when the container is not in use.

13. A closure according to claim 8, wherein said closing means comprises a closure cap.

14. A method of dispensing a viscous material, comprising steps of:

(a) opening a container of viscous material by opening a closure that is secured to the container;

(b) inverting the container to induce the viscous material to flow out of the container through the closure; and (c) intercepting a volume of thin liquid that has formed on top of the viscous material during storage by guiding the thin liquid into a collection space that is defined within the closure before the volume of thin liquid passes out of the closure, thereby ensuring that the material first dispensed from the container will be more representative of the viscous material than the thin liquid.

15. A method according to claim 14, further comprising a step of:

(d) re-mixing the thin liquid from the collection space into the viscous material as dispensing progresses.

* * * * *